United States Patent [19]

D'Andrade

[11] 4,227,508

[45] Oct. 14, 1980

[54] TOY AUTOMATIC PISTOL FOR PING PONG BALLS

[75] Inventor: Bruce M. D'Andrade, Flemington, N.J.

[73] Assignee: Arco Industries Ltd., Hong Kong, Hong Kong

[21] Appl. No.: 972,247

[22] Filed: Dec. 22, 1978

[51] Int. Cl.[3] ..... F41B 7/08

[52] U.S. Cl. ..... 124/16; 124/37; 124/49; 124/41 C

[58] Field of Search ..... 124/16, 27, 37, 41 R, 124/50, 49, 21, 25, 28, 29; 273/26 D

[56] References Cited

U.S. PATENT DOCUMENTS

| | | | |
|---|---|---|---|
| 71,162 | 11/1867 | Hall . | |
| 473,808 | 4/1892 | Arno . | |
| 1,183,133 | 5/1916 | Sperry . | |
| 1,206,865 | 12/1916 | Lefever . | |
| 1,240,987 | 9/1917 | Lefever . | |
| 2,053,152 | 9/1936 | Kiesel . | |
| 2,652,822 | 9/1953 | Griffith | 124/27 |
| 2,737,942 | 3/1956 | Horowitz et al. . | |
| 2,814,285 | 11/1957 | Yamauchi | 124/27 |
| 2,830,569 | 4/1958 | Sakuta et al. | 124/37 UX |
| 2,830,570 | 4/1958 | Horowitz et al. | 124/37 X |
| 3,408,997 | 11/1968 | DeRuymbecke et al. | 124/27 |

*Primary Examiner*—Richard C. Pinkham
*Assistant Examiner*—William R. Browne
*Attorney, Agent, or Firm*—C. Hercus Just

[57] ABSTRACT

A toy pistol for shooting ping pong balls having a frame with a barrel portion at the forward end and a handle extending downward from the rearward end, a magazine extending upward and rearward therefrom, a ram movable along longitudinal guide member in the frame rearward from said barrel portion, a compression spring to fire the ram forward, and a T-shaped combination trigger and sear having a head with a sear movable generally parallel to and below said guide members, the stem of said T-shaped member being movable into the forward portion of said handle and said head having pins on the opposite end movable in forward and rearward guide slots in the frame, the rearward slot extending rearward and downward, whereby near the end of rearward movement of said T-shaped member the rear end of said head is moved downward to disengage the sear on said head from said ram which is fired forwardly by said compression spring and a tension spring automatically restores the T-shaped member forwardly to starting position.

3 Claims, 9 Drawing Figures

10
12
14
16
24
34
36
42
46
76
4

10
14
22
24
26
28
33
34
36
38
40
42
44
46
50
52
58
76

10
12
14
16
24
33
34
36
46
76

TOY AUTOMATIC PISTOL FOR PING PONG BALLS

BACKGROUND OF THE INVENTION

For many years, toy pistols have been developed for firing different types of projectiles and in more recent years, such toy guns have been developed to fire relatively harmless ping pong balls, and the present invention pertains to a toy pistol of that type. Many types of guns for firing different types of projectiles have been developed heretofore in which the plunger or ram for firing the projectile is retracted manually and certain guns also have been developed as toys in which, by operation of a trigger, the ram is retracted, a projectile falls into position to be engaged by the ram, and continued retracting movement of the ram automatically compresses a spring for the ram and, near the end of the rearward movement of the trigger, a sear is released from the ram to fire the projectile from the barrel. Typical examples of this type are illustrated in the following prior U.S. Pat. Nos.:

No. 71,162—Hall—Nov. 19, 1867
No. 473,808—Arno—Apr. 26, 1892
No. 1,240,987—Lefever—Sept. 25, 1917

In the foregoing patents, when the retracting means for the plunger is moved rearwardly, the rearward end thereof is cammed downwardly to release the sear on the retracting member and permits a compressed spring to drive the plunger forwardly. In the patents to Hall and Arno, it appears that the trigger must be manually moved forward to restore it to initial position, but in Lefever, there is a spring to accomplish this.

Prior art is also present in the form of the following patents which include means to retain a positioned ball or projectile in the barrel from falling out of the same until fired. Typical examples of U.S. Pat. Nos. of this type are:

No. 1,183,133—Sperry
No. 1,206,865—Lefever—Dec. 5, 1916
No. 2,053,152—Kiesel—Sept. 1, 1936

A still further prior patent, U.S. Pat. No. 2,737,942, to Horowitz et al, dated Mar. 13, 1956, shows a spring-return means for the trigger, whereby the toy gun is automatic and a sear on the trigger automatically releases the plunger near the end of the retraction of the trigger.

At present, it is very popular to manufacture toy guns, especially toy pistols from plastic material and in order to adapt certain basic principles of operation to guns molded from plastic materials, the present invention has been devised and incident to perfecting the same, certain novel features have been included therein which are not disclosed in the prior art, details of which are described hereinafter and illustrated in the drawings of the application.

SUMMARY OF THE INVENTION

One of the principal objects of the invention is to provide a toy pistol in which, with few exceptions, all parts are manufactured by molding the same from appropriate plastic materials, including a pair of complementary shells which comprise a frame that has in the forward position thereof, a simulated barrel portion terminating inwardly in a seat to receive a ping pong ball by gravity from an upwardly and rearwardly extending magazine cavity which is above a projectile ram mounted in guide means extending longitudinally of said frame, the ram being projected forwardly by a compression spring that is compressed incident to a combination T-shaped trigger and sear mounted with the head thereof below and substantially parallel to said guide means, the head of the member having a sear thereon engageable with a holding projection on the lower portion of the ram and the stem of the T-shaped member is movable toward and from the open forward edge of a depending hollow handle member integral with the frame and comprising part of the shells which form the frame and handle as a unit, the improvement comprising guide pins on opposite ends of the head of the T-shaped member which are respectively movable in molded guide slots spaced longitudinally in the frame, the forward slot being substantially parallel to the guide means for the ram and the rearward slot extending rearward and downward, whereby rearward movement by the trigger moves said head rearwardly and the rear end thereof projectively is moved downwardly, as well as rearwardly, to finally cause disengagement of the sear on said head from the holding projection on the ram, whereby the compression spring fires the ram forwardly to project a ping pong ball disposed in said seat from the forward end of the barrel of the frame.

Another object of the invention is to provide a tension spring respectively connected at the opposite ends thereof to said frame and head of the T-shaped member for purposes of restoring the same to its initial starting position automatically when the stem of the T-shaped member is released to permit such restoration movement, a further improvement comprising providing the rearward guide slot with vertical clearance in the forward portion thereof in order that the pin on the rearward end thereof can move downwardly during such restoration movement and thereby permit the sear to clear the holding projection on the ram and move past the same in forward direction and to insure reengagement of the sear with the holding projection incident to moving the ram rearwardly, rearward movement of the depending trigger comprising the stem of the T-shaped member tending to pivot the head around the axis of the forward pin and thereby, cause the rearward end of the T-shaped member to move upwardly and insure engagement between the sear and holding projection, such movement also being in conjunction with the tendency of the tension spring to preferably be arranged to slope rearwardly and downwardly and thus, exert a tilting movement upon said head of the T-shaped member about the axis of the forward pin and aid in insuring coengagement between the sear and holding projection.

Still another object of the invention is to provide restraining means within the walls of the simulated barrel for purposes of preventing movement by gravity of a ball disposed in the seat at the rearward end of the barrel incident to the ram being retracted and prior to the release of the ram for forward movement to project the ball from said seat and barrel.

Details of the foregoing objects and of the invention, as well as other objects thereof, are set forth in the following specification and illustrated in the accompanying drawings comprising a part thereof.

DESCRIPTION OF THE PREFERRED EMBODIMENTS

Figure 3:
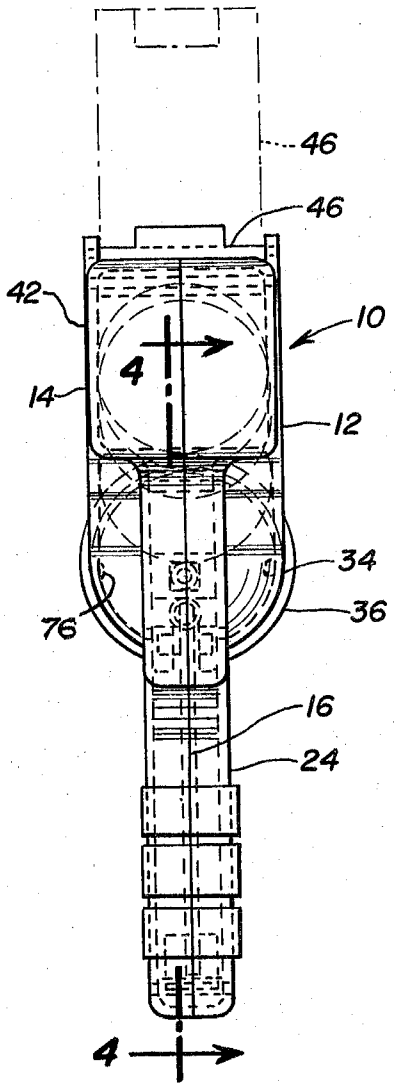
FIG. 3 is a rearward elevation of the toy pistol shown in FIG. 1.

The pistol 10 is composed of a pair of complementary side shells 12 and 14 which meet along a central plane 16 and, when united, provide a hollow interior for purposes to be described. The shells may be united, for example, by conventional interfitting lugs and recesses or projections having recesses therein to receive the lugs, exemplary lugs 18 and hollow recesses 20 being shown in exemplary manner in FIG. 4. Said lugs and recesses are secured together by appropriate cement in accordance with conventional practice.

Figure 4:
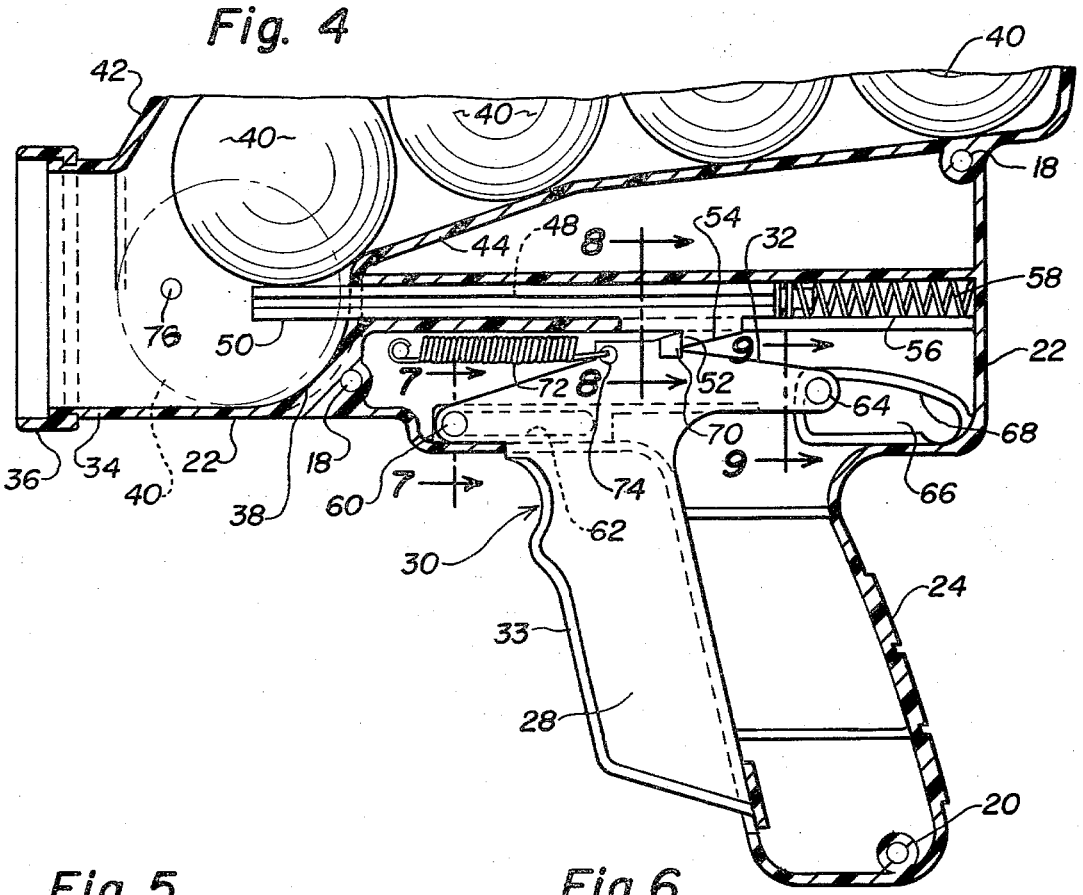
FIG. 4 is a fragmentary vertical sectional view of the pistol shown in FIG. 1, as seen on the line 2—2 of FIG. 3, FIG. 4 being on a slightly larger scale than that employed in the preceding figure.

The united shells form a frame 22 for the pistol 10, said frame extending longitudinally and the same is provided with a downwardly extending projection 24, which comprises a handle for the pistol, said handle being hollow and the forward edge 26 thereof having an elongated opening therein to receive the stem 28 of a T-shaped member comprising a combination trigger and sear, which is best shown in FIG. 4, said member having a head 32 which is transverse to the stem 28 and the stem 28 actually comprises the trigger member which is movable laterally into and from the hollow interior of the handle 24. For both strength and comfort in using, the forward edge of the stem 28 comprising the trigger is provided with a transversely-extending flange 33, which is perpendicular to the plane of the main portion of the stem 28.

Figure 1:
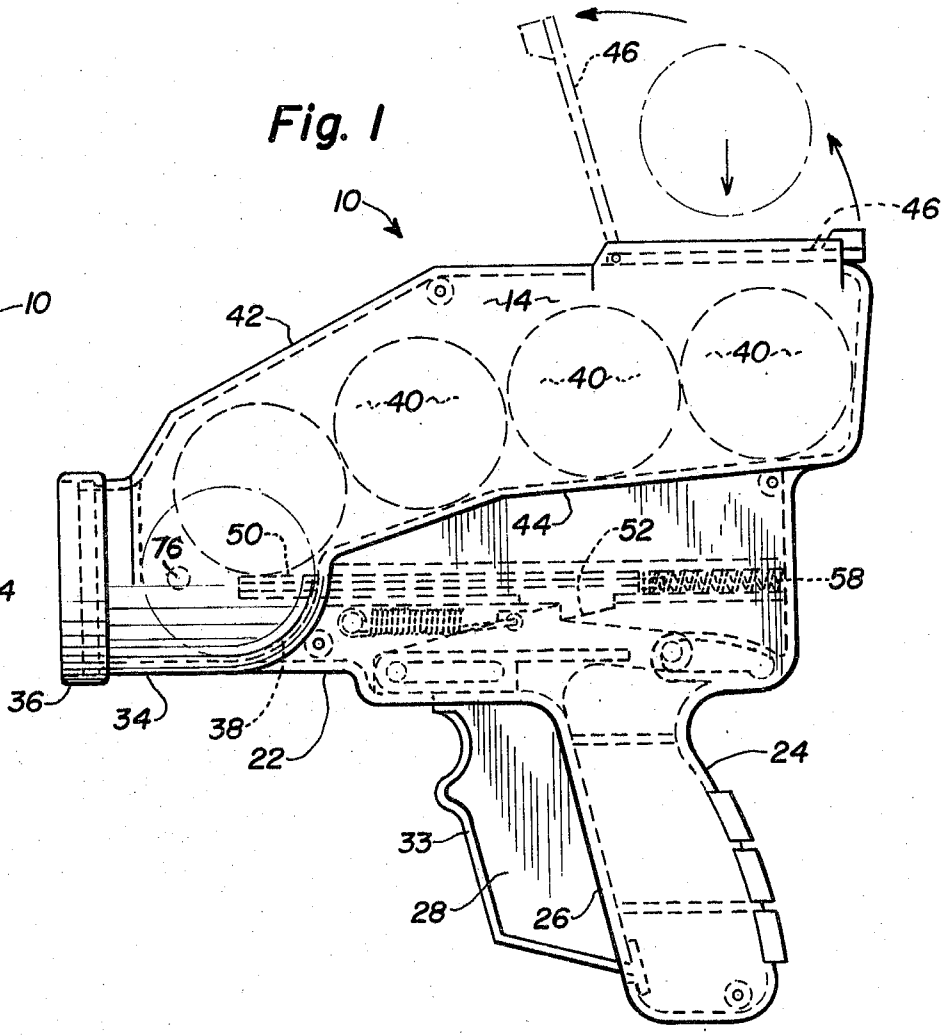
FIG. 1 is a side elevation of the preferred form of a toy pistol embodying the principles of the invention and illustrating, in phantom, the open position of a cover for the magazine and a ping pong ball in position to be introduced into the upper rearward end of the magazine, said figure also showing in phantom certain details of the invention on the interior of the shell comprising the frame of the toy pistol.
Figure 2:
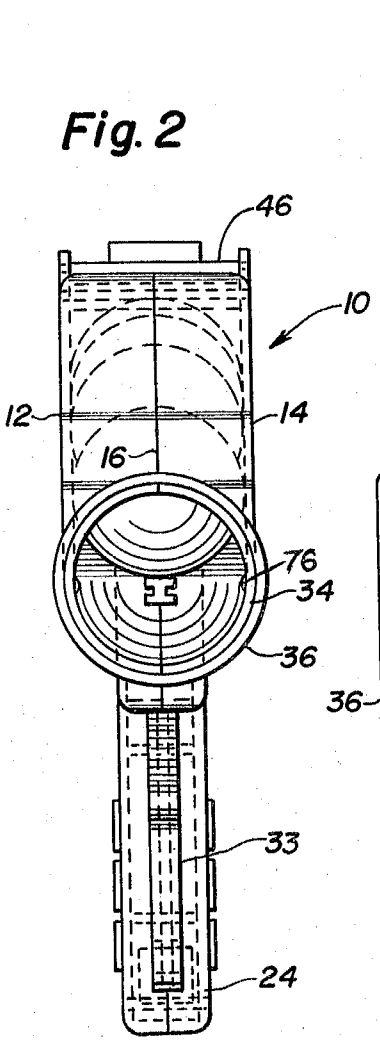
FIG. 2 is a front elevation of the toy pistol shown in FIG. 1.

The forward portion of the pistol 10, which is that shown at the left-hand end of FIGS. 1 and 4, includes a relatively short simulated barrel 34, which is circular in end view as shown in FIG. 2, and the outer end thereof may be circumscribed by a band 36, which also is formed of plastic. As readily seen from FIGS. 2 and 3, the barrel 34 is circular in cross-section and the inner end thereof terminates in a partially spherical seat 38, which is complementary to the shape of a ping pong ball 40.

Extending upward and rearward from the seat 38 is an elongated magazine 42, the upper confines of which are defined by the mating edge portions of the shells 12 and 14 and the lower portion of the magazine 42 is defined by co-engaging curved flanges 44, the magazine actually comprising an elongated cavity capable of holding a limited number, such as four or five ping pong balls 40, the rearward upper portion of the magazine 42 comprising a filling opening which is closed by a hinged cover 46, best shown in FIGS. 1 and 3. The forward end of the elongated cavity comprising the magazine merges smoothly into the seat 38 so as to offer no impedance to the movement by gravity of the ping pong balls from the magazine to the seat 38, as especially can be visualized from FIG. 1.

Figure 5:
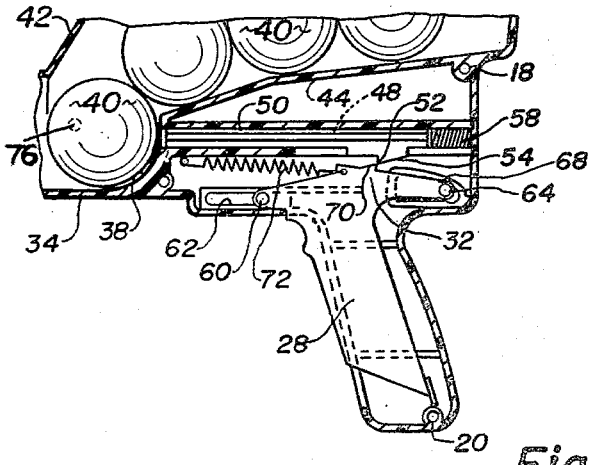
FIG. 5 is a fragmentary view, similar to FIG. 4, but on a smaller scale and showing the sear at the moment of disengagement thereof with the ram disposed in position to move forwardly.
Figure 6:
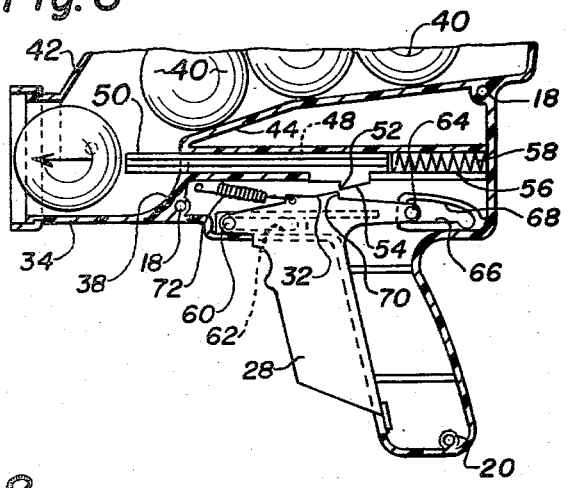
FIG. 6 is a fragmentary view, similar to FIG. 5, but showing the T-shaped combination trigger and sear in the restored forward position in which the sear has cleared the holding projection on the ram to enable the rear end of the head of the trigger member to move upwardly.
Figure 8:
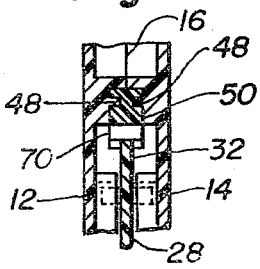

The complementary shells 12 and 14 also respectively enclose guide means comprising opposing channels and ribs 48, best shown in FIG. 8, said ribs extending into channels formed in the opposite sides of an elongated ram 50, which as also shown in FIG. 8, is substantially H-shaped when viewed at 90° to the illustration in FIG. 8. Said ram has a depending holding projection 52, the lower surface of which extends rearwardly and upwardly and comprises a cam surface 54, as shown in FIGS. 4–6. Within an appropriate socket 56 formed in the rearward portion of frame 22 and in axial alignment with the ram 50 and engageable with the rearward end thereof, is a compression spring 58, said spring being in expanded position in FIGS. 4 and 6, and in compressed position in FIG. 5.

Figure 7:
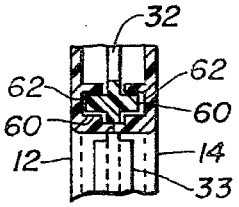
FIGS. 7, 8 and 9, respectively, are fragmentary vertical sectional elevations as seen on the lines 7—7, 8—8, and 9—9, in FIG. 4, and showing details of the co-engageable elements, in particular, on the T-shaped combination trigger and sear, and also on the ram and guide means therefor, as well as the holding projection on said ram.

One of the most important features of the present invention comprises the details and functions of the head 32 of the T-shaped member comprising said head and the stem 28 thereof, as well as the means which support the same. The forward end of the head 32 is provided with a pair of oppositely extending pins 60, which are slidable within elongated slots 62 which oppose each other and actually comprise longitudinal extending recesses parallel to the guide channels and ribs 48 but disposed below the same, as clearly shown in FIGS. 4–6, and the disposition of the pins 60 within the opposed slots 62 is best shown in FIG. 7.

Figure 9:
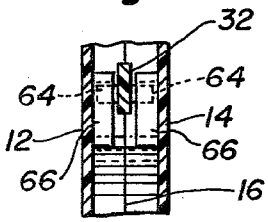

The rearward end of the head 32 terminates in a pair of oppositely projecting rearward pins 64, best shown in FIGS. 4 and 9, which are disposed respectively in rearward slots 66, comprising somewhat elongated, irregularly shaped cavities, also shown in FIGS. 4–6. The upper surfaces 68 of said slots or cavities extend rearward and downward in a gradual curve along which the rearward pins 64 slidably move incident to the trigger and sear 30 moving inwardly toward the right, as viewed in FIGS. 4–6.

The upper edge of the head 32, intermediately of the ends thereof, is provided with a sear 70 which, as shown in FIG. 8, actually is substantially wider than the head 32, to insure engagement thereof with the forward face of the holding projection 52, which engagement is illustrated in FIG. 4. Extending below the guide channels and ribs 48 is a tension spring 72, the forward end of which is connected to an appropriate pin fixed to the frame 22 and the rearward end thereof extends through a hole 74, see FIG. 4, in the head 32.

The operation of the pistol is as follows: Said operation is automatic and occurs by manually engaging the downwardly extending stem 28 which comprises the combination trigger and sear 30 and pressing the same into the interior of the hollow handle 24. Since the sear 70 initially is in engagement with the holding projection 52 on the ram 50, such movement will move the ram 50 rearwardly and thereby compress the spring 48 and place the spring 72 under tension. The forward pins 60 slide within the slots 62 along a straight line parallel to the guide channels and ribs 48, while the rearward pins 64 gradually move downward due to the downwardly curved upper surface 68 in the rearward slot 66. At a certain period in such rearward movement, the forward end of the ram 50 will be retracted substantially entirely from the seat 38 at the rear end of the simulated barrel 34 and thereby allow the forwardmost ball 40 in the magazine 42 to drop by gravity into the seat 38. Continued rearward movement of the trigger and sear 30 will cause the rearward pins 64 to be depressed to such extent by the time they are disposed in the rearward end of the rearward slots 66 that the sear 70 will disengage the holding projection 52 and the compressed spring 58 will immediately shoot the ram 50 forwardly to project the ball 40 within the seat 38 forwardly through the barrel 34. The compressed spring 38 is substantially of higher strength than the tension spring 72, but the latter is of such strength that upon release of the trigger and sear 30, the spring 72 will restore the same to its initial forward position and in so doing, the sear 70 will engage the cam surface 54 of the holding projection 52 and be depressed downwardly thereby. This will cause the rearward pins 64 to move vertically downward and the forward end of the irregularly-shaped slots 66 permits such movement due to the clearance arranged at said forward end of the slots 66. Accordingly, the sear and holding projection will be restored to the initial position thereof, shown in FIG. 4, and such clearance between said sear and holding projection is illustrated in FIG. 6, while in FIG. 5, the illustration shows the relative position of the sear and holding projection 52 at the instant the sear has released said projection to permit forward projection of the ram 50 by the compressed spring 58. Accordingly, it will be seen that the actual firing of the pistol, as well as restoring the same to initial position for the next shot, is automatic under all circumstances and it is only necessary to release the trigger and sear member 30 to permit the restoration thereof to the initial starting position.

It also will be observed that in the preferred arrangement of the interior elements of the pistol, the lowering of the rear portion of the head 32 causes the spring 72 to be disposed in a somewhat rearward and downward sloping position which serves to aid in restoring the sear into its engagement with the forward face of the holding projection 52 at the completion of the forward movement of the trigger and sear member 30, and under such circumstances, the forward pins 60 serve as pivots to control such movement. In the event, however, that full restoration of the sear 70 into engagement with the holding projection 52 is not accomplished by the spring 72, the initial compression movement of the trigger and sear member 30 by manual engagement also serves to move the head 32 about the pivotal axis of the forward pins 60, and thus, insure that the sear 70 will be restored to full engagement with the forward face of the holding projection 52 on the ram 50.

As shown in various figures of the drawings, there is at least one obstruction 76 projecting into the walls of barrel 34. In FIG. 1, it will be seen that in the normal forward position of ram 50, the forward end thereof prevents the forwardmost ball 40 from dropping into seat 38. When the combination trigger and sear 30 is moved partially rearward, the forward end thereof will retract from the seat into the hollow interior of frame 22 and permit the forwardmost ball to drop into seat 38 from the magazine. To prevent such positioned ball in seat 38 from falling from the forward end of barrel 34, the projecting obstructions 76 offer sufficient restraint on the ball moving outward solely by gravity. However, the obstructions 76 are short and preferably rounded so that when the ball in seat 38 is struck sharply by the ram 50, the force is adequate to cause the ball to overcome the restraint offered by obstruction 76 and be propelled a substantial distance beyond barrel 34.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

I claim:

1. A toy pistol for holding a supply of and automatically firing ping pong balls comprising in combination, an elongated frame having a simulated barrel at the forward end thereof and a hollow handle having a forward open edge and extending downward from the axis of said frame adjacent the rearward end thereof, a magazine for storage of ping pong balls in the upper portion of said frame sloping upward and rearward from said simulated barrel and discharging into said simulated barrel, guide means extending along the axis of said frame from the rearward end thereof, a firing ram slidable along said guide means for movement axially of said frame from a retracted position therein to a fired position in which the forward end of the ram forcefully strikes a ball in the simulated barrel to fire it therefrom, and a compression spring at the innermost end of said guide means in said frame adjacent said rear end thereof and engageable with said ram to fire it forwardly when said spring is released from a compressed condition; the improvement comprising a rigid T-shaped member comprising a combination trigger and sear having the head thereof extending beneath the guide means and generally parallel thereto for axial movement between fully forward and rearward positions and the stem of said T-shaped member comprising the trigger and extending along the forward edge of said handle and movable into and outward from said open forward edge of said handle, said ram having a holding detent extending downward and the opposite ends of the head of said T-shaped member having pins projecting laterally therefrom and said frame having a pair of longitudinally-spaced forward and rearward guide slots in which said pins on said head are slidably received for guiding movement of said head, said rearward slot having an upper edge sloping rearward and downward, a tension spring secured respectively at its opposite ends to said frame and the head of said T-shaped member, and a sear projecting from the upper portion of the head of said T-shaped member and engageable with said holding detent on said ram when said head is in its fully forward position, whereby when said trigger on said T-shaped member is moved manually toward and into said handle, said head moves rearward and said compression spring is compressed and the tension spring is tensioned and the rearward pin on said head is moved downward along said upper edge of said rearward slot while moving rearward therein to compress said compression spring until near the end of said movement when the sear automatically disengages the holding detent to permit the compression spring to fire the ram against a ball in said simulated barrel and project it therefrom while said tension spring automatically restores said T-shaped member to the fully forward position thereof and in which the forward end of said ram is in its extended firing position in which it blocks movement of the next ball in the magazine from entering said barrel, said forward end of said rearward slot having vertical clearance to permit said pin in said slot to move downward incident to moving forward to restoring position and thereby allow the sear and holding projection to move past each other.

2. The toy pistol according to claim 1 in which said holding detent has a lower cam surface extending rearward and upward to cam said sear downward incident to passing the same when moving forward with said trigger to forwardmost starting position.

3. The toy gun according to claim 1 in which said guide means comprise elongated slots and said pins on said T-shaped member project from opposite sides thereof and said frame comprises a pair of complementary molded shells in which said slots for said pins respectively are formed.

* * * * *